US010603238B1

(12) United States Patent
Yakovleva et al.

(10) Patent No.: US 10,603,238 B1
(45) Date of Patent: Mar. 31, 2020

(54) SYSTEM FOR DELIVERING AND RELINQUISHING MEMORIES

(71) Applicants: Inessa Yakovleva, Odessa, FL (US); Mark Gaker, Odessa, FL (US)

(72) Inventors: Inessa Yakovleva, Odessa, FL (US); Mark Gaker, Odessa, FL (US)

( * ) Notice: Subject to any disclaimer, the term of this patent is extended or adjusted under 35 U.S.C. 154(b) by 0 days.

(21) Appl. No.: 16/521,658

(22) Filed: Jul. 25, 2019

(51) Int. Cl.
*A61G 17/08* (2006.01)
*A61G 17/007* (2006.01)
*A44C 25/00* (2006.01)

(52) U.S. Cl.
CPC ..... *A61G 17/08* (2013.01); *A44C 25/004* (2013.01); *A61G 17/007* (2013.01)

(58) Field of Classification Search
CPC .... A61G 17/08; A61G 17/007; A44C 25/004; B65D 59/04; B42D 15/04; B42D 15/042; B42D 15/047
USPC ..... 27/1; 229/93, 92.8; 63/1.14; 206/226; 40/124.5, 124.06
See application file for complete search history.

(56) References Cited

U.S. PATENT DOCUMENTS 262,080 A 8/1882 McLeary
477,217 A 6/1892 McCoy
601,869 A 4/1898 Busch
718,562 A 1/1903 Blackinton
1,032,282 A * 7/1912 Hay ..... B65D 3/04 229/93
1,112,640 A 10/1914 Mix
1,457,770 A * 6/1923 Dodge ..... B65D 65/04 229/92
1,459,783 A * 6/1923 Loufek ..... B65D 3/04 229/125.22
1,473,393 A * 11/1923 Albertoni ..... B65D 3/20 229/93
1,814,467 A 7/1931 Cedar
2,037,504 A * 4/1936 Drake ..... B65D 27/00 229/92.9
2,128,644 A 8/1938 Gitter
2,222,366 A * 11/1940 Glass ..... B65G 51/06 229/93
2,728,450 A * 12/1955 Haire ..... B65D 75/06 206/459.5
2,756,924 A * 7/1956 Abrahamson ..... B65D 59/04 229/93
2,827,309 A 3/1958 Fred
3,077,981 A * 2/1963 Gaspard ..... F21V 35/00 206/223
3,100,047 A * 8/1963 Wallace ..... B42D 15/047 206/215
4,353,379 A 10/1982 Castellanos
4,977,652 A 12/1990 Graham
5,193,360 A 3/1993 Lovegrove
5,208,957 A 5/1993 Hereford
5,611,124 A 3/1997 Biondo et al.
(Continued)

FOREIGN PATENT DOCUMENTS

DE 20110088 U1 * 10/2001 ..... B65D 51/245

*Primary Examiner* — William L Miller
(74) *Attorney, Agent, or Firm* — Larson & Larson, P.A.; Justin P. Miller; Frank Liebenow

(57) ABSTRACT

The system is a means of communicating between a user in a third-party, the third-party may be alive or deceased. In summary, the system is the recordation of a memory an apology or praise, memorialized in physical form, such as in a letter, the letter than stored in an item such as lock it and the item shared with a third party or carried by the user.

8 Claims, 7 Drawing Sheets

(56) References Cited

U.S. PATENT DOCUMENTS 5,729,921 A 3/1998 Rojas
5,755,116 A 5/1998 Sparacino et al.
5,787,626 A 8/1998 Bingham et al.
5,815,897 A 10/1998 Longstreth
5,950,287 A 9/1999 Cacciatore et al.
6,237,837 B1 * 5/2001 Martin ..... B65D 27/04 229/307
6,557,750 B1 * 5/2003 Druse ..... B65D 59/04 206/37.1
7,467,444 B1 12/2008 Johnson, Sr.
7,997,100 B2 8/2011 Fassas
8,364,549 B2 1/2013 Sell
8,397,944 B1 * 3/2013 Landes ..... B65D 43/0222 220/752
8,782,932 B2 * 7/2014 Rouzaud Giannetti ..... A47G 33/02 27/1
9,457,949 B1 * 10/2016 Hathaway, III .... B65D 81/3888
10,070,706 B2 9/2018 Gobbato
10,165,733 B2 1/2019 Lieberstein
2003/0182963 A1 10/2003 Beatty
2005/0081561 A1 4/2005 Eggleston
2005/0173504 A1 * 8/2005 Erdie ..... B65D 59/02 229/125.17
2007/0187290 A1 * 8/2007 Zimmerman ..... A45C 11/24 206/784
2012/0137549 A1 * 6/2012 Caszatt ..... E04H 13/003 40/124.5
2013/0105349 A1 * 5/2013 Lafler ..... B65D 59/02 206/457
2013/0153453 A1 * 6/2013 Simpson ..... B65D 85/00 206/389
2014/0041168 A1 * 2/2014 Giannetti born Rouzaud ..... A61G 17/08 27/1

* cited by examiner

SYSTEM FOR DELIVERING AND RELINQUISHING MEMORIES

FIELD

This invention relates to the field of sharing memories and well-wishes and more particularly to a system for recording and passing memories, apologies, and praise to living or deceased friends or family members.

BACKGROUND

Sometimes it is too hard to say what needs to be said.

For example, it is not always possible to have important conversations while someone is still alive. Perhaps it is too difficult to share the memory, praise, or apology that is needed. Or the opportunity never arises, or death comes unexpectedly.

Alternatively, the other person may be alive, and there is an apology or praise that we have an opportunity to share, but doing so in a conversation is too stressful. For example, apologizing after an argument, or sharing praise.

When we are prevented from saying what we want or need to say, the unsaid things build up. The result is anxiety, regret, and a feeling of failure.

What is needed is a way of letting go of a memory, apologizing after an argument, or giving feedback to someone, it is impossible or difficult for us to do.

SUMMARY

The system is a means of communicating between a user and a third-party, the third-party alive or deceased. In summary, the system is the recordation of a memory, an apology, or praise, memorialized in physical form, such as in a letter, the letter then stored in an item such as locket and the item shared with a third party or carried by the user. The act of writing a letter gives the user an opportunity to shift his or her perspective, creating space for self-evaluation and forgiveness.

In greater detail, the first step of the method is to wait until event occurs to the third-party. For example, something that prompts the sharing of a memory, apology, or praise, such as a death, an argument, or a celebration. A celebration may be a birthday party, the anniversary of an event, a wedding, or a baby shower. Or the celebration may be a holiday such as Christmas or Veteran's Day. The event affects both the user and a third-party, thus connecting the user and the third-party and creating a reason to share a memory, an apology, or praise.

Triggered by the event, the user writes a letter to the third-party. The letter is written on something physical, such as a piece of paper. The letter is preferably hand-written using pen or pencil.

The letter is then placed inside of communication container. The communication container is a physical item that can hold a letter and optionally hold ashes.

As an optional modification of the above method, the user may order the communication container and associated supplies, such as letter stock and envelopes, from a supplier. At the time of the order, the user provides the supplier with information regarding the party who will receive the communication container. This allows the supplier to provide a shipping label to the user, which the user then uses after filling the communication container. The result is that the user is more likely to successfully complete the method and ship the communication container.

With the letter securely inside the communication container, the user then transfers the communication container.

As a variation on the above method, the third-party can be an animal, such as a pet. Pets are part of families just like humans, and thus their passing is as difficult as losing a family member. Thus, one may wish to write a letter, and include ashes, to remember a lost pet.

By using the above method, there is always a chance to communicate feelings, thoughts, greetings, or praise to people we love, whether or not they have passed away. By being able to communicate in this way the user is freed from feelings of regret or negative emotions that may build up because of the inability to communicate.

Studies have shown that writing about stressful events, caused by events such as death or an argument, caused physical improvements. For example, decreases in inflammation and improved immune function.

Using the disclosed method allows one to write something for their loved ones to read after they are gone. Our relationships with people we love and care about should last even after we are no longer with them. A hand written letter may help those left behind to overcome grievances and suffering by cheering them up and letting them know that we bless them with our love, and that it was nothing more important for us than seeing them smile and see more moments of joy even when we can only watch them from the skies.

The communication container can take many different forms. For example, keepsake jewelry such as a locket, a key chain, or other items that have the space to hold a letter and an optional ash compartment. Other embodiments include a flower pot into which the user may place a plant to add life to the stored memory.

Using this method, a user can write to their parent on Mother's Day or Father's Day, write to the son or daughter, or a girlfriend or boyfriend, and share something meaningful with a handwritten letter. The letter is held in its own compartment to avoid it being lost, and to indicate the value and meaning of the communication.

Hand-written communication is all the more critical in this time of instant messaging, email, and other digital communication. Such digital communication lacks the weight of a real letter.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
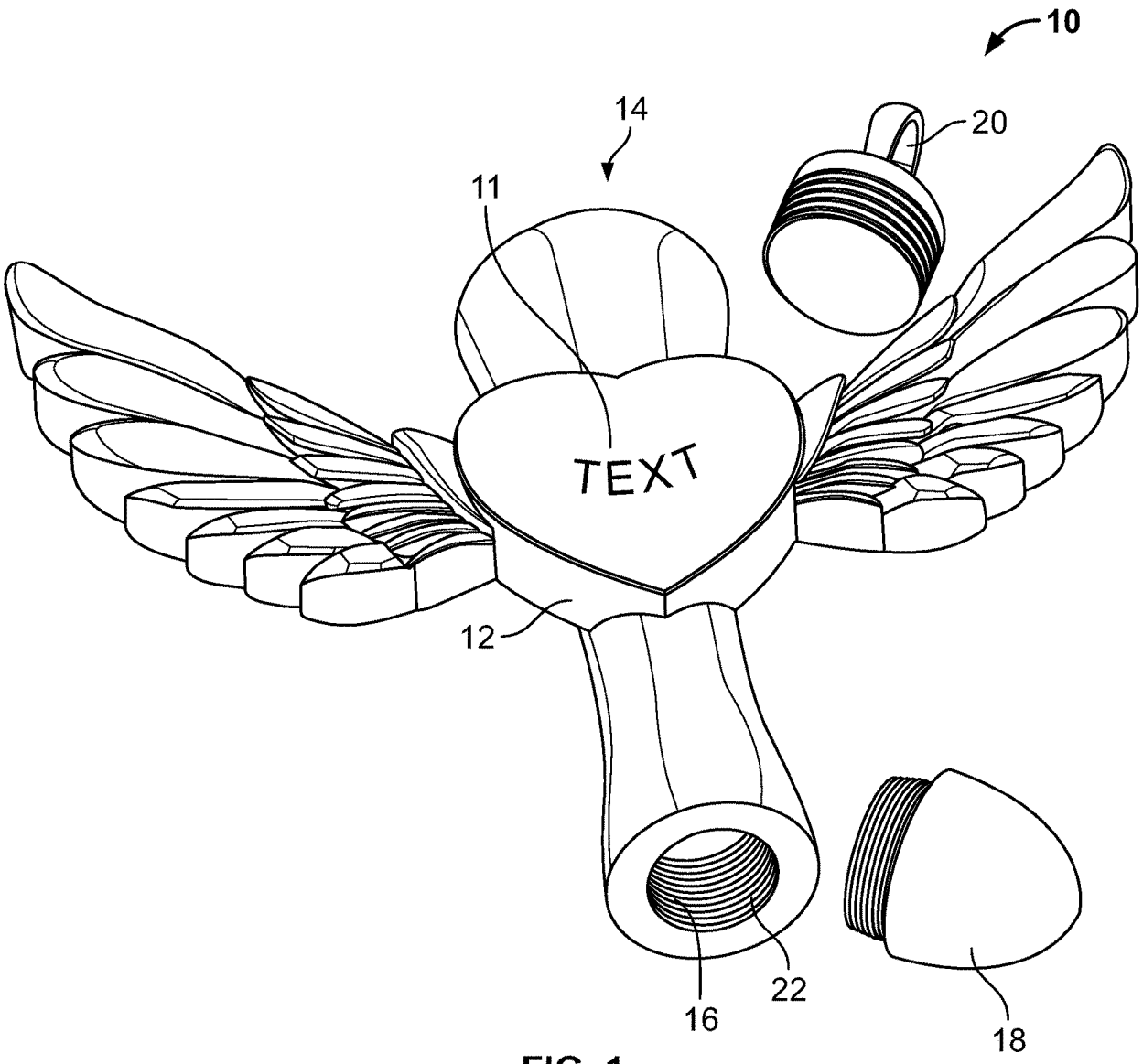
FIG. 1 illustrates a view of a first embodiment of a communication container.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of a first embodiment of a communication container is shown.

The communication container 10 includes a body 12, with an internal letter chamber 14. The letter chamber 14 is accessible through the letter chamber opening 16. An optional first seal 18 and second seal 20 close the letter chamber 14, and optionally engage the body 12 using threads 22.

The communication container 10 includes optional text 11, such as a message or identification of the individual giving, or receiving, the communication container 10.

Figure 2:
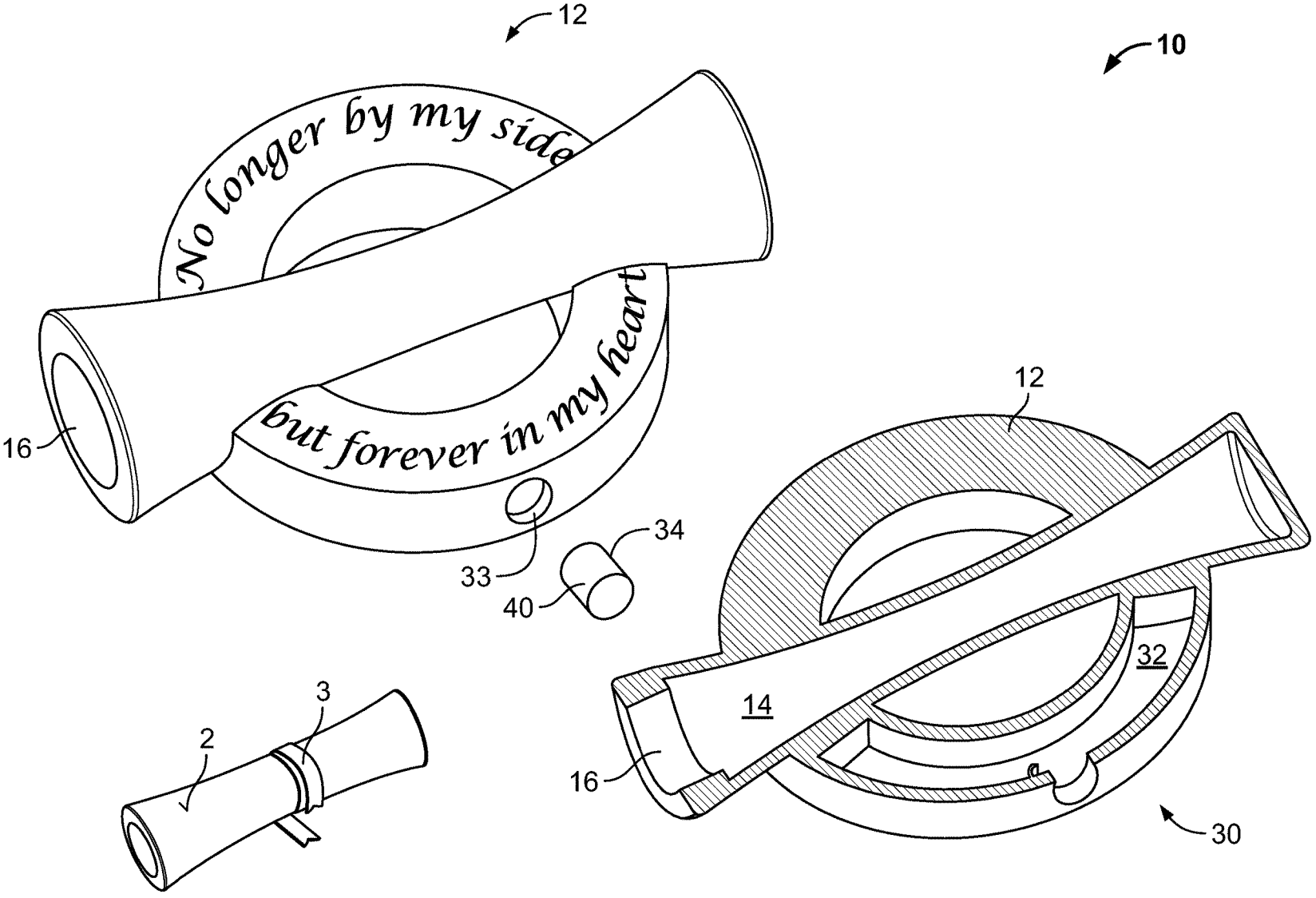
FIG. 2 illustrates an outer and cross-sectional view of a second embodiment of a communication container.

Referring to FIG. 2, an outer and cross-sectional view of a second embodiment of a communication container is shown.

The second embodiment of the communication container 10 again includes a body 12, with an internal letter chamber 14. The letter chamber 14 is accessible through the letter chamber opening 16.

A letter 2 is shown, tied with optional ribbon 3.

An ash compartment 30 includes an ash chamber 32, accessible via an ash chamber opening 33. A seal 34 closes the ash chamber 32, shown here using a plug 40.

Figure 3:
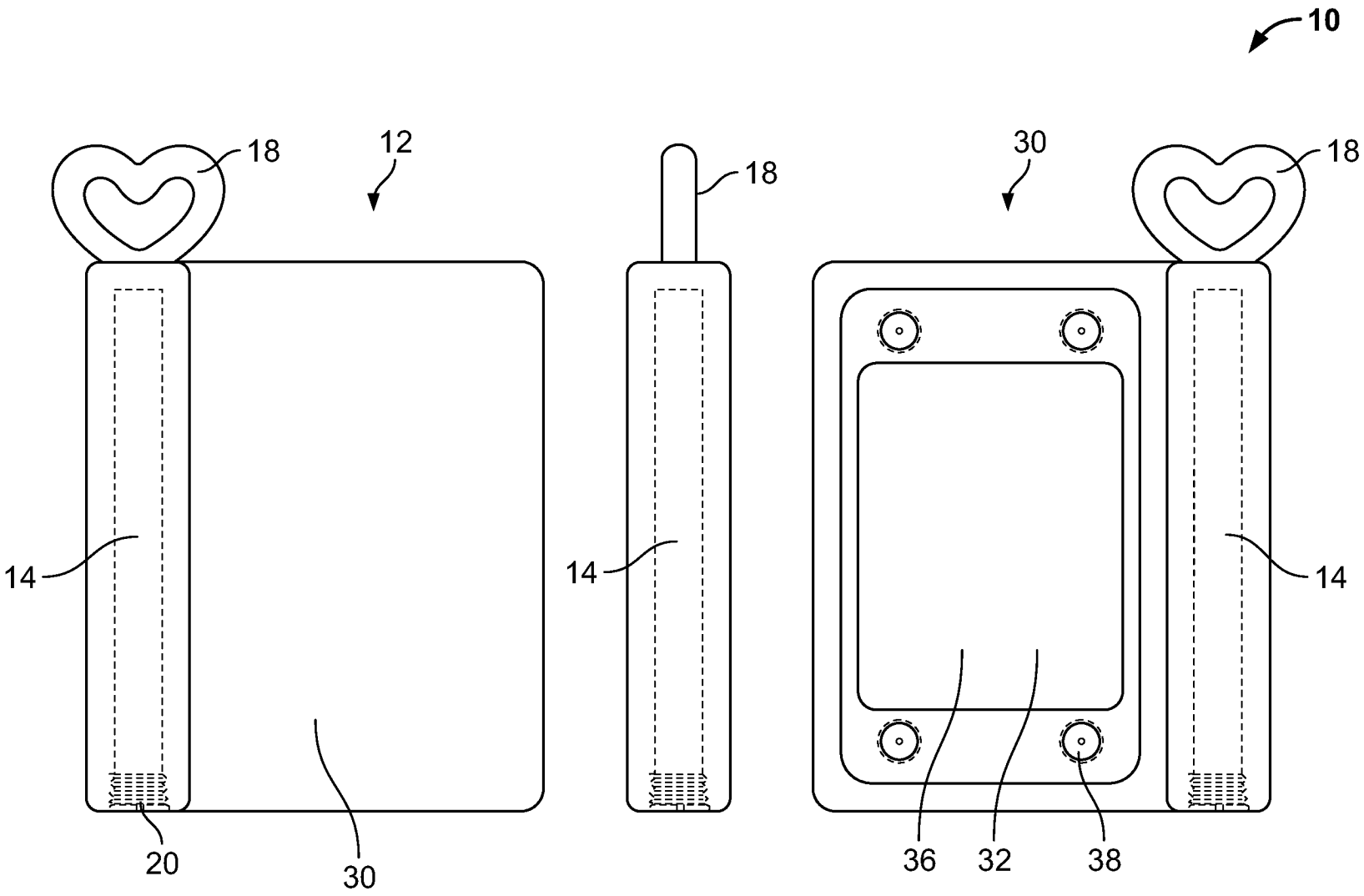
FIG. 3 illustrates an outer and partially-transparent view of a third embodiment of a communication container.

Referring to FIG. 3, an outer and partially-transparent view of a third embodiment of a communication container is shown.

The third embodiment of the communication container 10 again includes a body 12, with an internal letter chamber 14. The letter chamber 14 is accessible through the letter chamber opening 16 (see FIG. 1), closed using first seal 18 and second seal 20.

An ash compartment 30 includes an ash chamber 32, sealed using a plate 36, held in place by fasteners 38.

Figure 4:
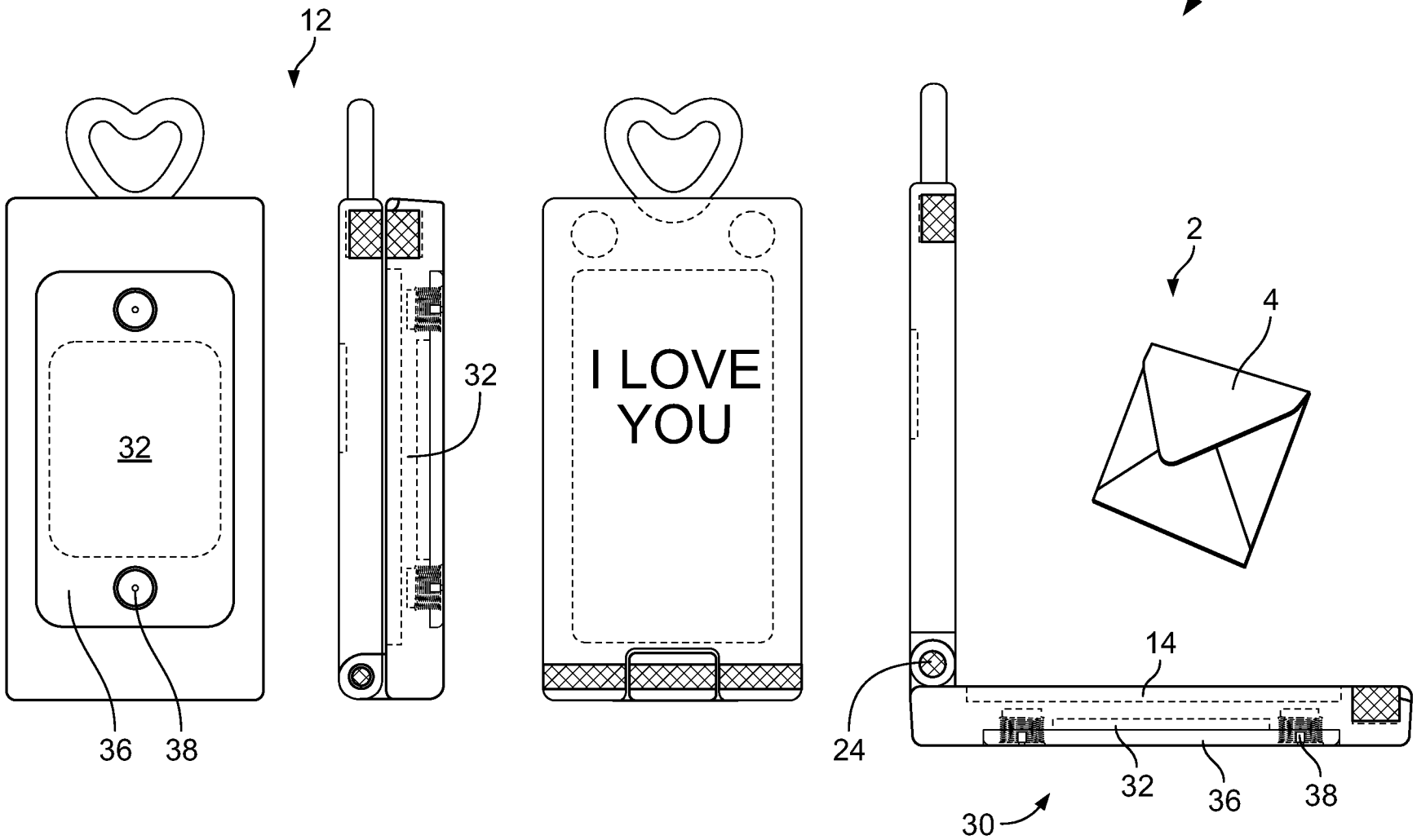
FIG. 4 illustrates an outer and partially-transparent view of a fourth embodiment of a communication container.

Referring to FIG. 4, an outer and partially-transparent view of a fourth embodiment of a communication container is shown.

The fourth embodiment of the communication container 10 again includes a body 12, with an internal letter chamber 14. The letter chamber 14 is accessible using the hinge 24 to open the communication container 10, exposing a recess that forms the internal letter chamber 14.

A letter 2 is shown within an envelope 4 for placement within the letter chamber 14.

An ash compartment 30 includes an ash chamber 32, sealed using a plate 36, held in place by fasteners 38.

Figure 5:
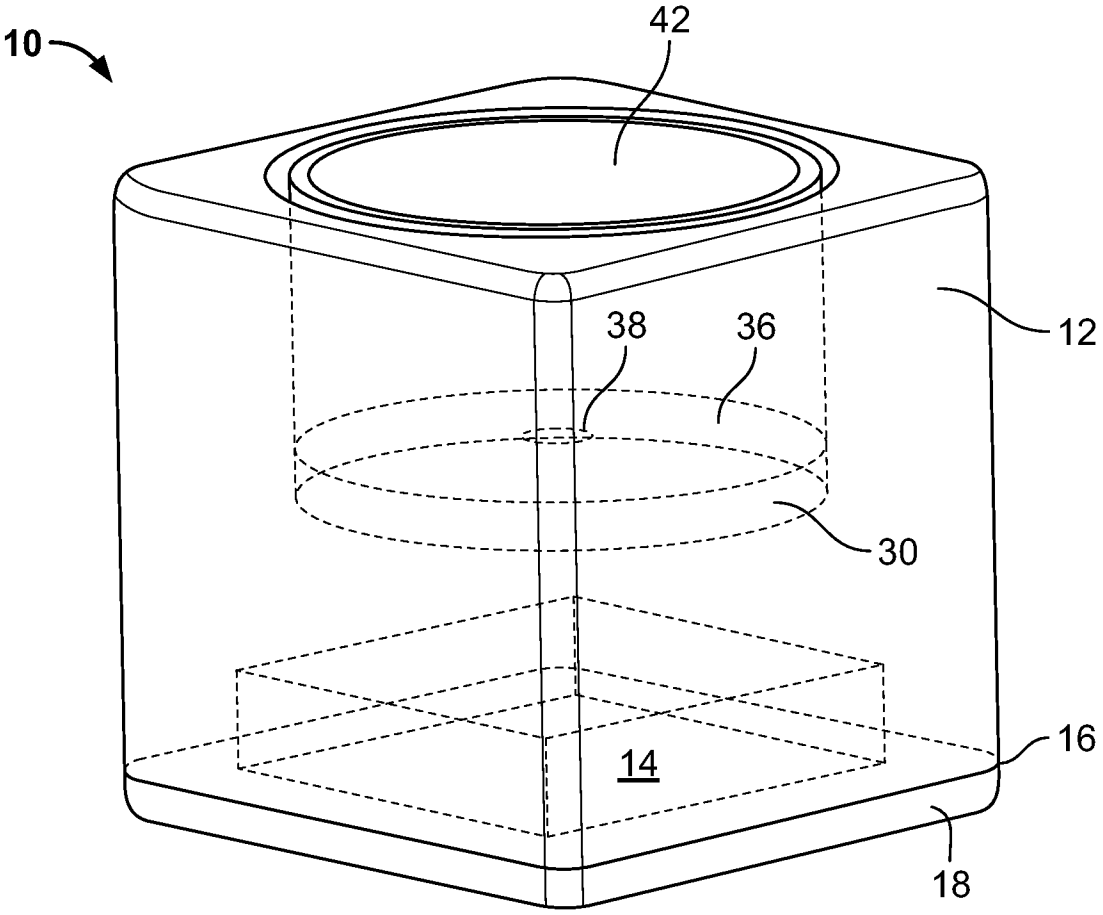
FIG. 5 illustrates a fifth embodiment of a communication container that includes a recess for a candle.

Referring to FIG. 5, a fifth embodiment of a communication container that includes a recess for a candle is shown.

The fourth embodiment of the communication container 10 again includes a body 12, with an internal letter chamber 14. The letter chamber 14 is accessible through letter chamber opening 16, accessible by removing first seal 18. First seal 18 is preferably held to body 12 using magnets (not shown).

The internal letter chamber 14 is larger than in other embodiments, allowing for the use of thicker, or more, paper.

An ash compartment 30 is sealed using a plate 36, held in place by fastener 38.

A candle depression 42 allows for insertion of a candle (not shown) to help the user remember the third-party.

Figure 6:
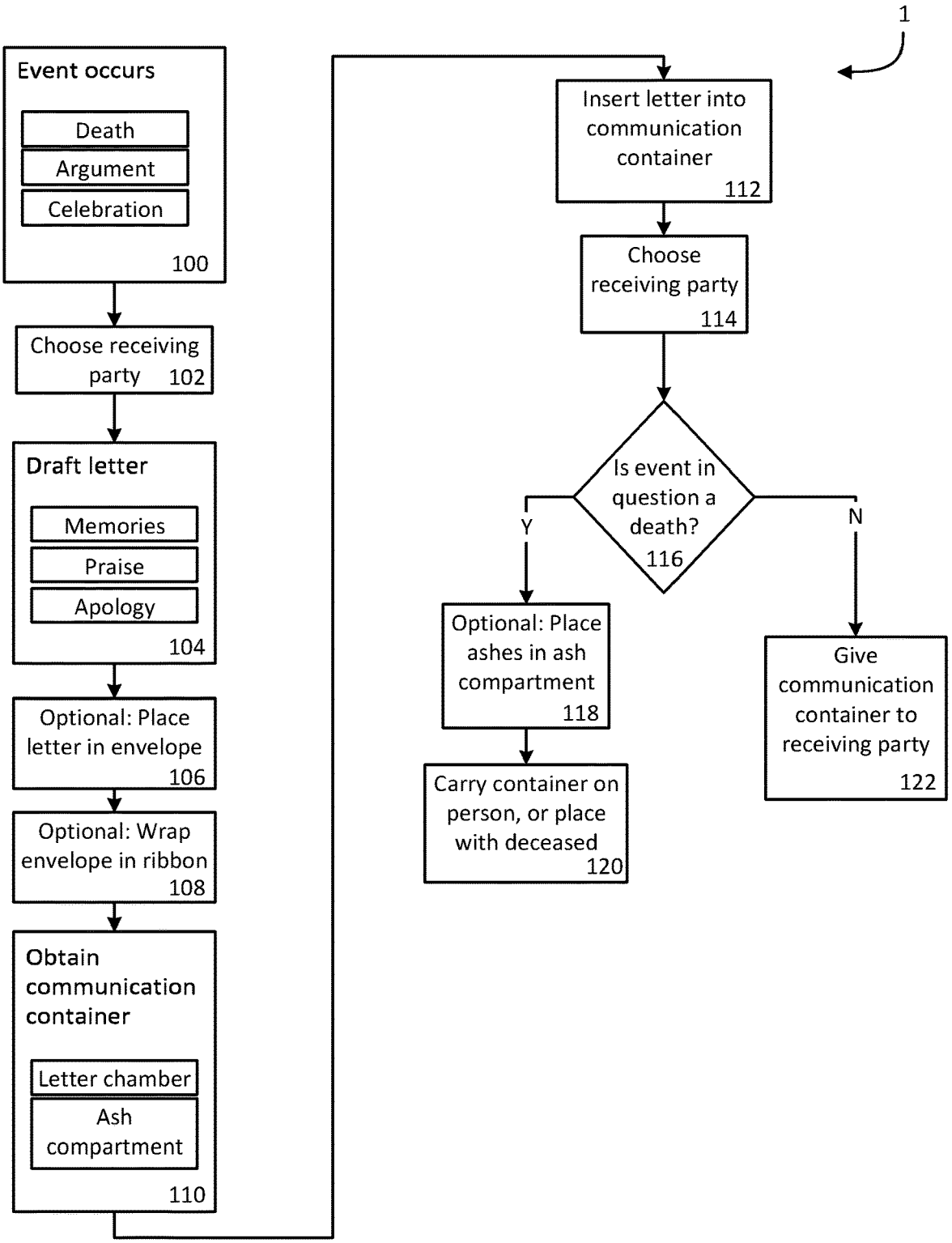
FIG. 6 illustrates the steps of executing the disclosed method.

Referring to FIG. 6, the steps of executing the disclosed method are shown.

The method of the eternity letter communication system 1 is prompted by the occurrence of an event 100. For example, a death, an argument, or a celebration. Upon the occurrence of an event the user chooses a party 102 to receive a letter.

A letter is then drafted 104. The letter preferably includes memories, praise, or an apology.

After drafting, the letter is then optionally folded in place in an envelope 106.

Alternatively, or in addition to placing in an envelope, the letter is wrapped in a ribbon 108.

The user then obtains a communication container 110. The communication container includes a letter chamber and optionally includes an ash compartment.

The user then inserts the letter into the communication container 112.

The user then chooses the receiving party 114.

The determination of the receiving party is affected by whether or not they invent question is a death 116.

If the event is a death the user optionally adds ashes to the ash compartment 118. The user then decides whether to carry the container on her person or to place the container with the deceased third-party 120.

Not a death the user then gives the communication container to the receiving party the third-party 122.

Figure 7:
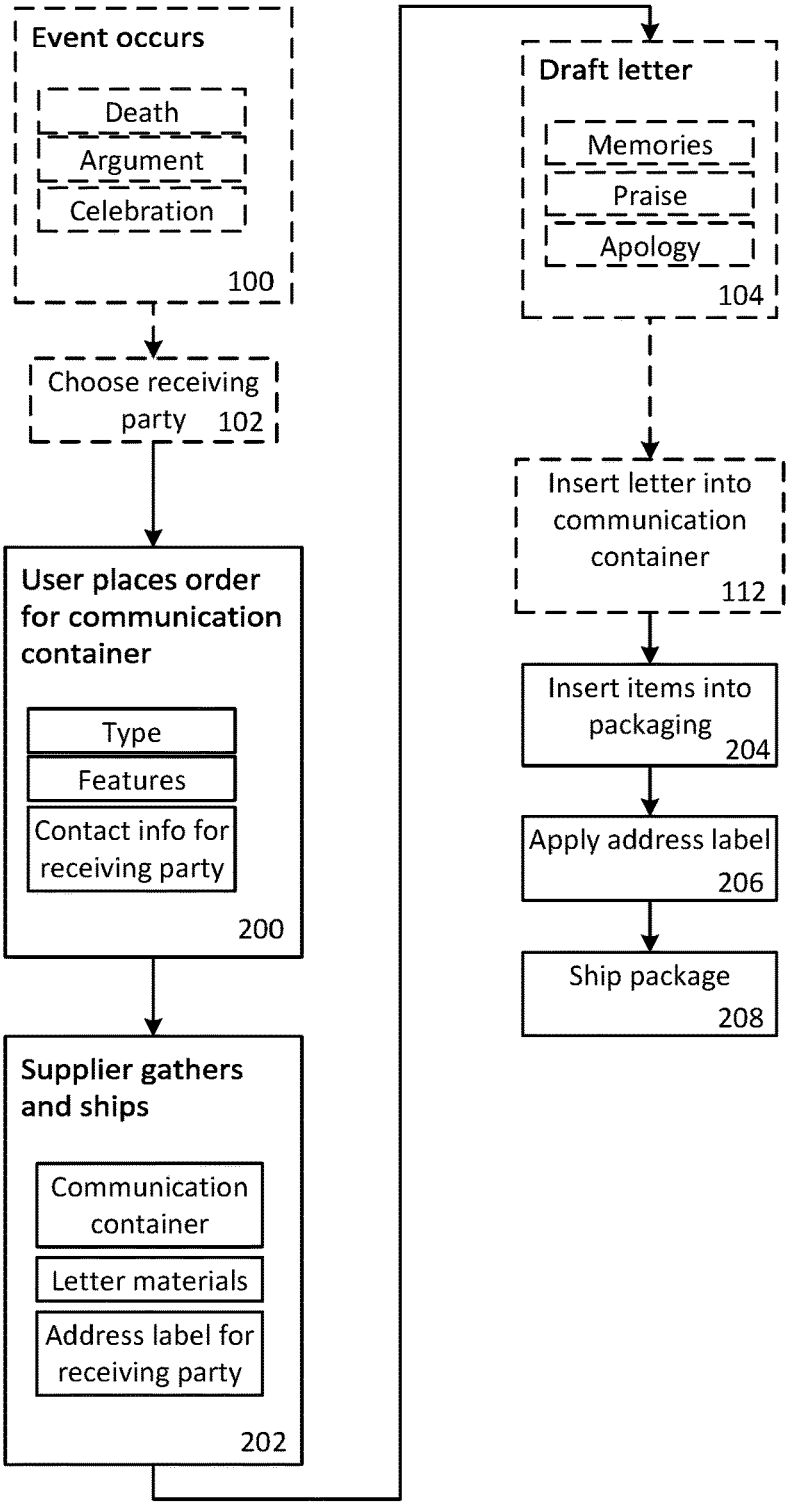
FIG. 7 illustrates optional additional steps of executing the disclosed method.

Referring to FIG. 7, additional optional steps of executing the disclosed method are shown.

Streamlining the process of sending the communication container to the receiving party increases the chances that the user will be able to complete the process and send the letter and communication container.

Following steps of occurrence of an event 100, and choosing a party 102 to receive a letter (see FIG. 6), the user places an order for a communication container 200. The order is likely placed using the Internet, but other means of placing an order are anticipated.

The order includes the type of communication container desired, the communication container features, and contact information for the receiving party.

The supplier then gathers and ships 202 the requested items. Included is; the communication container; letter materials such as paper, ribbon, envelope; and an address label for the receiving party.

The address label may include pre-paid shipping information, avoiding the need for the user pay for shipping later.

Steps 104 of drafting the letter through step 112 of inserting the letter are followed (see FIG. 6), then the user inserts the communication container into the packaging 204, applies the address label 206, and ships the package 208.

This modification of the method disclosed in FIG. 6 eases the process of shipping the communication container by avoiding the need for the user to again locate address information for the receiving party.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method for communicating between a user and a third-party, the method comprising the steps of:

waiting until an event occurs to the third-party;

after the event occurs, the user writing a letter to the third-party, the letter including a message;

the letter written on a physical medium;

after writing the letter, the user obtains a communication container;

the communication container includes:

a body;

a letter chamber within the body;

the letter chamber shaped to hold the letter which is a rolled or folded letter;

an ash compartment;

the ash compartment including an ash chamber that is accessible by way of a removable seal;

whereby the ash compartment allows the user to hold ashes of the third-party;

after obtaining the communication container, the user inserts the letter into the letter chamber of the communication container;

after inserting the letter, the user transfers the communication container to a receiving party;

whereby the user can achieve lasting communication with the third-party, even though such communication may otherwise be impeded by death or hesitance to have a difficult conversation; and wherein the event is a death of the third-party.

2. The method of claim 1, wherein the message is comprised of memories, praise, or an apology.

3. The method of claim 1, the communication container further comprising:

a first seal;

the first seal closing an opening to the letter chamber;

whereby the user removes the first seal, inserts the letter into the letter chamber, and then closes the first seal.

4. The method of claim 1, wherein the method comprises the following step between inserting the letter into the letter chamber and transferring the communication container:

removing the removable seal of the ash compartment;

inserting ashes of the third-party into the ash compartment; and replacing the removable seal of the ash compartment.

5. The method of claim 4 wherein the receiving party is the user.

6. The method of claim 4 wherein the receiving party is the third-party.

7. A method that allows a user to share a memory, praise, or apology with a third-party by allowing the user to encapsulate the memory, praise, or apology in physical form to create an encapsulated memory, praise, or apology storing the encapsulated memory, praise, or apology in a communication container, the user then either holding the communication container or physically transferring the communication container to the third-party party, thereby allowing the user to let go of the memory, praise, or apology, the method comprising:

upon occurrence of a death of the third-party, the user writes a letter;

the letter contains the memory, praise, or apology;

the letter is written on a piece of paper;

after writing the letter, the user obtains the communication container;

the communication container is ornamental and intended to displayed by the user, by the third-party, or near the third-party;

the communication container includes a letter chamber to contain the letter;

the letter chamber sealing using a first seal that interfaces with a letter chamber opening;

after obtaining the communication container, the user inserts the letter into the letter chamber of the communication container;

after inserting the letter into the letter chamber, the user seals the letter chamber by inserting the first seal into the letter chamber opening;

the communication container further includes an ash compartment;

the ash compartment including an ash chamber that is accessible by way of a removable seal;

whereby the ash compartment allows the user to hold ashes of the third party;

the user transfers the communication container to a place of internment of the third-party who is deceased;

whereby the user is able to transfer the memory, apology, or praise to the third-party, thus allowing the user to move on and release any associated guilt or grief.

8. The method of claim 7, the method comprises the following step between inserting the letter into the letter chamber and transferring the communication container:

removing the removable seal of the ash compartment;

inserting ashes of the third-party into the ash compartment; and replacing the removable seal of the ash compartment.

* * * * *